United States Patent [19]

Rebel

[11] Patent Number: 4,655,523

[45] Date of Patent: Apr. 7, 1987

[54] STAND FOR CORDLESS ELECTRIC APPLIANCE

[75] Inventor: Joachim Rebel, D-Reichenbach/Fils, Fed. Rep. of Germany

[73] Assignee: Geka-Werk Reinhold Klein K.G., Fed. Rep. of Germany

[21] Appl. No.: 754,434

[22] Filed: Jul. 12, 1985

[30] Foreign Application Priority Data

May 17, 1985 [DE] Fed. Rep. of Germany ..... 3517831

[51] Int. Cl.[4] ..... H01R 13/44

[52] U.S. Cl. ..... 339/40; 339/43; 248/117.2

[58] Field of Search ..... 339/40, 41, 42, 43; 248/117.1, 117.2, 117.3, 117.4, 51

[56] References Cited

U.S. PATENT DOCUMENTS

| | | | |
|---|---|---|---|
| 2,530,471 | 11/1950 | Kopisch | 248/117.3 |
| 3,637,986 | 1/1972 | Laing | 219/519 |
| 4,528,429 | 7/1985 | Dobson et al. | 339/40 |

FOREIGN PATENT DOCUMENTS

| | | |
|---|---|---|
| 580709 | 7/1933 | Fed. Rep. of Germany . |
| 2036286 | 1/1972 | Fed. Rep. of Germany . |
| 7105435 | 5/1972 | Fed. Rep. of Germany . |
| 2212228 | 9/1973 | Fed. Rep. of Germany . |
| 1059238 | 11/1953 | France . |
| 1229442 | 9/1960 | France . |
| 595573 | 12/1947 | United Kingdom . |

*Primary Examiner*—Eugene F. Desmond
*Assistant Examiner*—Paula A. Austin
*Attorney, Agent, or Firm*—Roylance, Abrams, Berdo & Goodman

[57] ABSTRACT

A stand for a cordless electric appliance, especially a flatiron, has a base with a bottom member and a connection installation arranged essentially perpendicular to the bottom member. To leave a free space between the bottom member of the stand and the electric appliance placed on the stand, a connection installation housing is received in a molded part of the electric appliance and a support point for the electric appliance is arranged at some distance from the connection installation housing.

13 Claims, 3 Drawing Figures

STAND FOR CORDLESS ELECTRIC APPLIANCE

FIELD OF THE INVENTION

The present invention relates to a stand for a cordless electric appliance which detachably couples the appliance to an electrical power source.

BACKGROUND OF THE INVENTION

This application is related to U.S. patent application Ser. No. 754,435, filed concurrently herewith and entitled "Connection Installation for a Cordless Electric Appliance", the subject matter of which is hereby incorporated by reference.

In a known stand for a cordless electric flatiron, soft lamella are placed in the connection installation. The connection installation can be connected to a power source by a switch and has contacts for mating with the contacts of the flatiron mounded on the stand. Connection with the power source is produced by placing of the flatiron on the stand, where it rests completely on the bottom member of the stand. This known stand is disclosed in French Pat. No. 1,059,238.

SUMMARY OF THE INVENTION

An object of the present invention is to provide a stand for a cordless electric appliance which leaves a space between the stand bottom member and the cordless appliance, e.g., a flatiron supported on the stand.

Another object to the present invention is to provide a stand for a cordless appliance which is safe and simple to manufacture and operate.

The foregoing objects are obtained by a stand for a cordless appliance comprising a base with a bottom member, a connection mounted on and extending generally perpendicular to the base bottom member and a support. The connection releasably couples the cordless appliance to an electrical power source and has a housing shaped to receive a molded part of the cordless appliance in a wedge locking connection. The support is mounted on the base, is spaced by a distance from the housing and supports the cordless appliance.

The wedge-locking connection between the cordless electric appliance and the stand essentially holds the electric appliance in position securely. Overloading of the wedge-locking connection is avoided by the use of the support. If the cordless electric appliance is a flatiron, its base plate is protected from contact with the bottom member by having the flatiron rest upon the support. The movement to place the flatiron on the stand corresponds to the natural movement of ironing.

Preferrably, the connection housing and the molded part of the electric appliance are tapered upwardly. A frustoconical or truncated pyramidal construction can be used to provide the wedge locking connection of the housing and the appliance.

A protection member can be movably mounted in the housing to open and close selectively the bores in the installation housing providing access to the electrical contacts of the connection. This provides security for the electrical contacts mounted in the connection housing against unintentional electrical connection by inserting a plug or the like into the bores in the connection housing.

Advantageously, the support comprises an appliance contacting member of heat resistant material. This prevents damage to the stand if the heated part of the electric appliance, especially the base of the flatiron, is placed on the stand.

The support can be a cylindrical member mounted on a plug projection on the base bottom member. This provides an development of the stand.

An edge strip can be formed about the base bottom member to form a ventilation passage and to protect against inadvertent contact with the hot part of the appliance.

The connection of the connection cable about a base part provides a space-saving arrangement and a safe support of the stand. The connection cable is protected for the most part against damage by storage in the hollow space defined by the base part.

Additional ventilation can be attained by ventilation openings in the stand.

As used in the application, such terms as "vertical", "upwardly" and "above" are intended only to indicate relative positions, and not to limit the stand and appliance to any specific orientation.

Other objects, advantages and salient features of the present invention will become apparent from the following detailed description, which, taken in conjunction with the annexed drawings, discloses a preferred embodiment of the present invention.

BRIEF DESCRIPTION OF THE DRAWINGS

Referring to the drawings which form a part of this disclosure.

DETAILED DESCRIPTION OF PREFERRED EMBODIMENT

Figure 1:
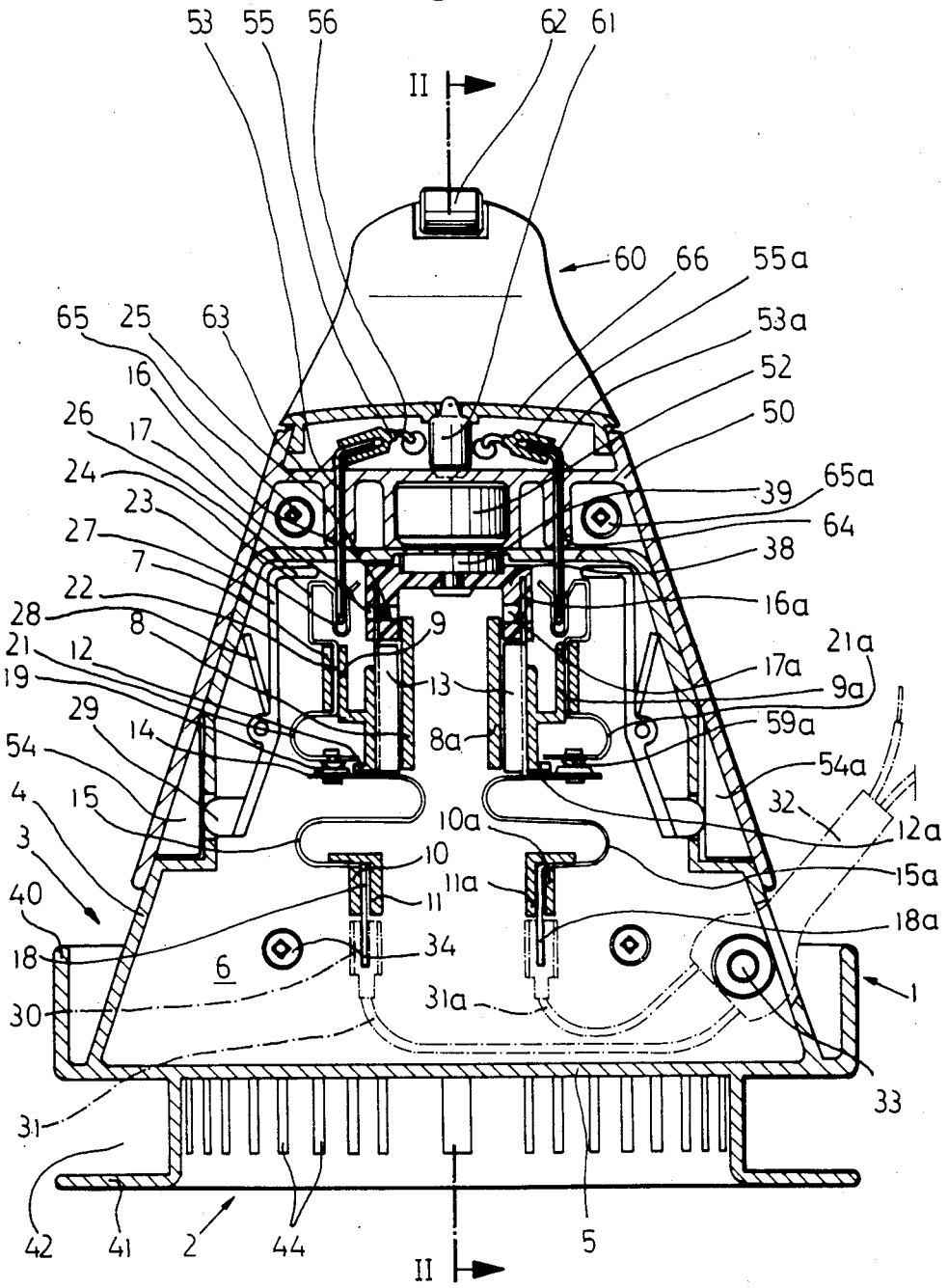
FIG. 1 is a rear elevational view in section of a connection installation and cordless appliance according to the present invention.

Referring to the drawings, a stand 1 has a base 2 and a connection installation 3. An installation housing 4 is arranged in base 2 perpendicular to bottom member 5. Base 2 and housing 4 are of a heat-resistant, electrically insulating material, generally plastic.

Housing 4 is configured essentially as a truncated pyramid. The front wall 6 is flat and perpendicular to base bottom member 5. Fastener projections 7 to 11 extend perpendicularly from front wall 6 on its side away from base 2 and form an integral one-piece construction with front wall 6. Fastener projections 7 and 8 are essentially plate-like members and are parallel with projection 8 being longer than projection 7. Fastener projection 9, located between projections 7 and 8, is essentially U-shaped. Each of the arms of projection 9 is arranged at some distance from fastener projections 7 and 8. The right arm of projection 9 extends downwardly and has a stop 12 projecting to the left as view in FIG. 1 of the drawing. Fastener projection 10 is generally identical to fastener projection 7. Fastener projection 11 is L-shaped and is arranged at some distance from projection 10. Fastener projections 7 to 11, as described hereinafter, are all configured as mounting parts.

A connection part or member 13 is U-shaped in transverse cross section and is located between fastener projections 8 and 9. A contact support flange 14 extends at a right angle to connection member 13 and is configured unitarily with connection member 13. An S-shaped first switch spring 15 is formed as a unitary extension of connection member 13. An attachment part 16 at the top of connection member 13 has a stopping flange 17 bent outwardly. The relatively great length of switch spring 15 lessens fatigue. Contact flange 14 supports a first switch contact stud 19. Contact flange 14 and stopping flange 17 are narrower than the middle part of connection part 13 or of attachment part 16.

The first switch spring 15 is a tension spring and has a connection part 18 angled downwardly and rearwardly on its bottom. Connection part 18 and the bottom of first switch spring 15 are held by fastener projections 8 and 9, as though through a slit.

A U-shaped second switch spring 21 carries a second switch contact stud 59 at its free end. A holder 22 is arranged on one of the U-shaped switch spring arms, and is fixed between fastener projections 7 and 9. A U-shaped bushing or connector 23 is formed integrally or unitarily at the top end of holder 22 by an essentially U-shaped spring part 24. Bushing 23 is widened at its upper end.

Parts 13 to 18 and parts 21 to 24 are all of one piece. They are each manufactured by a flexible, current-conductive material, and can be formed with mirror-image symmetry to permit them to be inverted. Connection part 13 and first switch spring 15 could also be composed of several parts. For instance, connection part 13 and switch spring 15 could be formed of different materials and as individual parts which are subsequently connected together.

A through bore 25 is found in a horizontal part of installation housing 4 over bushing 23. Bore 25 can be closed by a protection part 26 locatable between bushing 23 and through bore 25. Protection part 26 is a portion of a double-arm lever 27 pivotably mounted on a journal having one end thereof mounted on front wall 6. A safety spring 28 is formed as a unitary piece with safety lever 27 and abuts installation housing 4 to bias safety lever 27 in clockwise direction as viewed in the drawing. A contact member 29, arranged on the lower arm of safety lever 27, projects outwardly of installation housing 4 when projection part 26 is in a closed or safety position. Contact member 29 serves as a handle.

Parts 7 to 29 are in the left side of housing 4 as shown in the drawing. Corresponding mirror-image identical parts are provided on the other side of the housing with the same numbers and with the reference a. Only one reference numeral with or without a letter is given for any two identical parts to save space in the drawing.

A U-shaped contact member 38 of electrically insulating material is mounted with both of its arms on attachment parts 16 and 16*a*. The contact member arms have holes which mate with stopping flanges 17 and 17*a*. In its middle, contact member 38 carries a responsive contact part 39 of magnetizable material with as small as possible residual magnetism. Contact part 39 projects into a cutout on the bottom surface of the top part of housing 4.

A cable 31, as shown in broken lines, is attached to connection 18, by a connection clamp 30. Cables 31 and 31*a* are guided to the outside through a piece of elastic tubing 32 attached to front wall. Tubing 32 is pivotally mounted for movement about a horizontal axis by an attachment member 33. Cables 31 and 31*a* are connected with a connector plug.

A housing cover 35 is placed on the back or rear of housing 4 and has projections 36*a* and 37*a* on its inside surface projecting into housing. Projection 36*a* rests on fastener projections 7*a* to 9a, while projection 37*a* rests on fastener projections 10*a* and 11a. Each cover projection forms an abutment for the parts inserted between fastener projections 7*a* to 11*a*. The clearances between the fastener projections are closed by the cover projections. Fastener projections 7 to 11 are likewise closed by projections 36*a* and 37*a* which extend over the entire width of cover 35.

Figure 2:
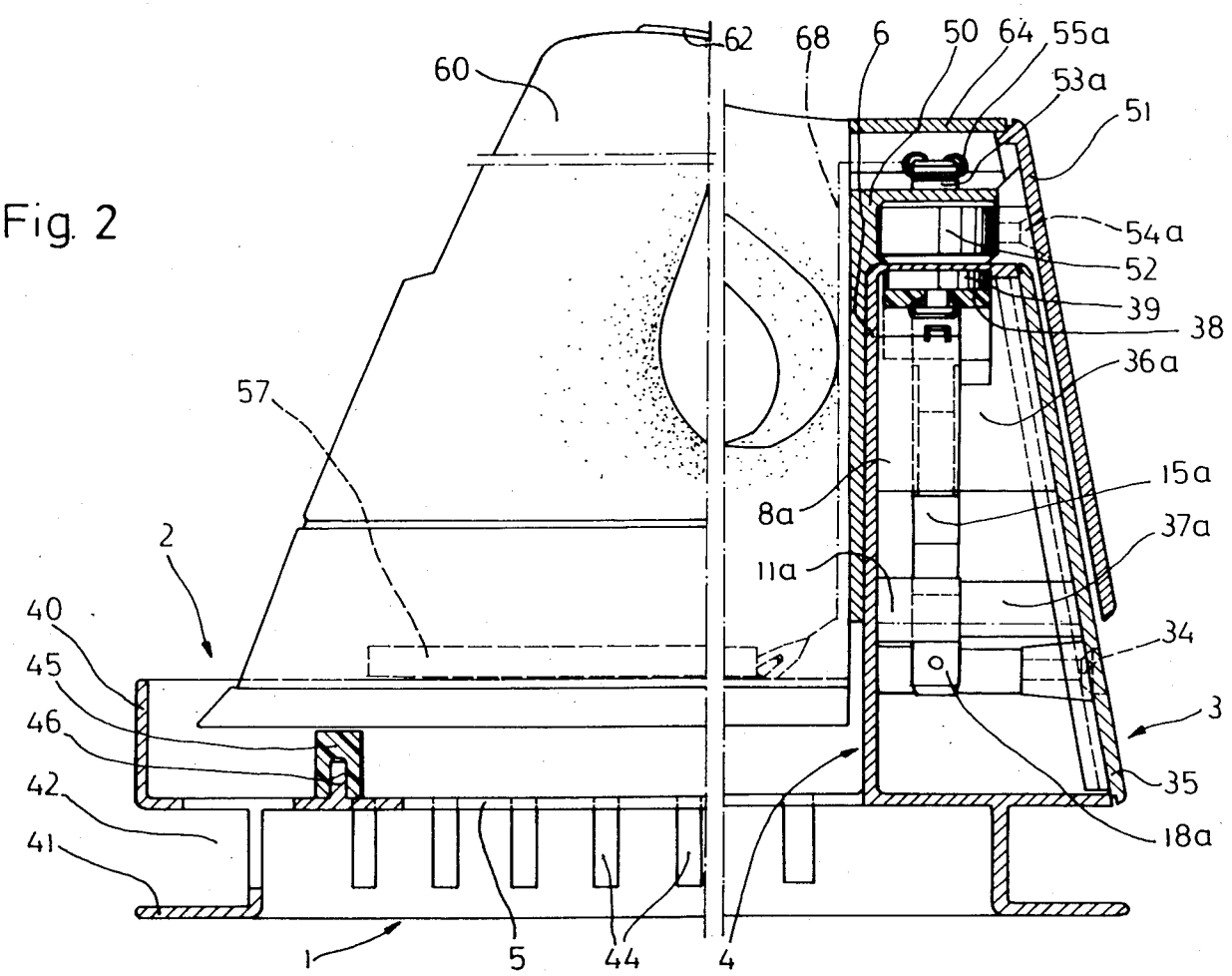
FIG. 2 is a side elevational view in section of the connection installation and cordless appliance taken along line II—II of FIG. 1.

Base 2 is essentially in the shape of a base plate for the flatiron 60, and has an edge strip 40 projecting over and surrounding its bottom member 5. Edge strip 40 surrounds flatiron 60 when it is in rest position. Strip 40 is spaced at some distance from bottom member 5. A base 41 depends from bottom member 5. Base 41 and bottom member 5, as seen in the transverse section of FIG. 2, define a U-shaped hollow space 42. Bottom member 5 has a middle open space 43 which is somewhat smaller than the base plate of flatiron 60, and has a series of oblong ventilation openings 44 around its edge. Openings 44 extend under and beyond a flatiron 60 placed on base 2.

Figure 3:
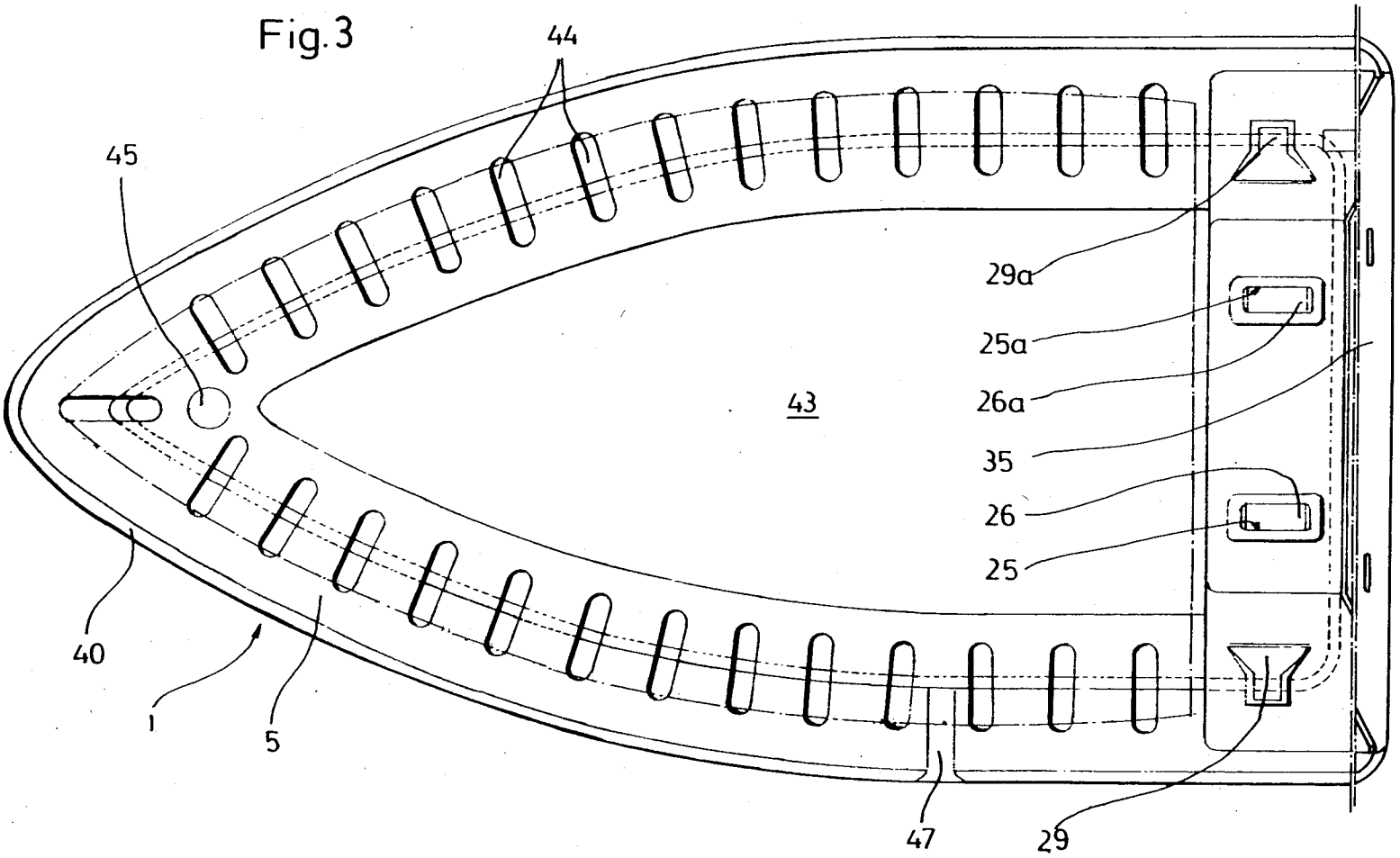
FIG. 3 is a top plan view of the connection installation without the cordless appliance.

A quadratic, cylindrical support member 45 of heat-resistant material, especially a ceramic stone (e.g., steatite), is mounted on bottom member 5. Support member 45 is adapted in shape to the bottom of flatiron 60, and is held by an attachment pin 46 integrally formed with bottom member 5 and projecting upwardly. Support member 45 is lower than edge strip 40, and supports the bottom edge of flatiron 60. Strip 40 and bottom member 5 have a radial recess 47 extending into hollow space 42 in the vicinity of connection installation 3 (FIG. 3). Hollow space 42 serves as a compartment for a cable connecting with cables 31 and 31*a*. The connecting cable is guided through the handle of flatiron 60 and through recess 47 into hollow space 42, in which it is stored and wound up. The free end of the cable can be inserted into recess 47 beneath the plug and held there.

Flatiron 60 is provided with a control switch 62, and temperature control, and a molded part 50 adapted to housing 4. Molded part 50 provided with a removable rear wall 51 on its side away from front wall 6 of housing 4. A disk-shaped permanent magnet 52 is mounted in a pocket in a transverse wall 63 open at the bottom and toward the rear wall 51 in molded part 50. Magnet 52, when arranged in the position illustrated in FIGS. 1 and 2 over contact member 38, forms a currentless relay with contact part 39. A narrow clearance is present between permanent magnet 52 and contact part 39 to prevent the attraction and adherence of the magnet parts.

Plug contacts 53 and 53*a* of electrically conductive material are mounted on each side of permanent magnet 52 in molded part 50. The plug contacts pass through through bores 25 and 25*a* and engage bushings 23 and 23*a*. Each plug contact 53, 53*a* rests in a bushing below transverse wall 63 and is supported by flanges at the top and bottom. Instead of the flanges forming the connection, a form-locking connection or the like can also be used.

Rear wall 51 is connected with molded part 50 by screws 65 and 65*a*. A projection, corresponding to projections 36 and 37, is found between screws 65 and 65*a* on rear wall 51, which projection securely holds permanent magnet 52 in front wall 6.

The truncated pyramidal internal shape of molded part 50 mates with installation housing 4. Housing 4 has recesses on its bottom for contacts 54 and 54*a* projecting from molded part 50 into the installation housing recesses. Contacts 54 and 54*a* interact with contact parts 29 and 29*a* of the safety levers 27 and 27*a*. Plugs 53 and 53*a* are connected through clamps 55, lines 56 and lines 68 with an electric heater 57 in flatiron 60.

The space in molded part 50 receiving contact clamps 55 and 55*a* is closed at the top by a cover 66 inserted into molded part 50 from the side. For this purpose, cover 66 has dovetailed side guide parts. A fluorescent lamp 61, which can be seen from above, rests in cover 66, and is illuminated when flatiron 60 is connected with the current source.

Molded part 50 rests on installation housing 4 in such a manner that a clearance is left between the bottom of flatiron 60 and bottom member 5 of base 2. The bottoms of the flatiron and base preferably extend parallel. Ventilation openings 44 allow air to pass from hollow space 42 into the intermediate space between flatiron 60 and the edge strip 40 of base 2. Strip 40, overlapping the base plate of flatiron 60, protects against contact and scalding during use of a steam iron.

When flatiron 60 is removed from stand 1, plugs 53 and 53*a* are removed from bushings 23 and 23*a*, i.e. the contacts are disconnected from each other. Before the contacts are disconnected from each other, the magnetizing force of the permanent magnet 52 is removed and contact part 39 drops rapidly downward until it stops at fastener projections 8 and 8*a*, as a result of the force of switch springs 15, 15*a*, and 21, 21*a*, breaking the connection with the current source. The prebiased second switch springs 21 and 21*a* move until their free ends engage stops 12 and 12*a*. This provides a high break speed for the contact studs 19 and 59, serving as switch contacts.

After plug contacts 53 and 53*a* are removed from through bores 25 and 25*a*, protection parts 26 and 26*a* protect bores 25 and 25*a* by closing them to the outside. Since contact projections 54, 54*a* have left the stops 29, 29*a* of safety levers 27 and 27*a*, the safety levers move to the closed position.

When flatiron 60 is placed on stand 1, the rear wall of molded part 40 slides along front wall 6 of the connection installation 3. Through bores 25 and 25*a* are freed by movement of safety levers 27 and 27*a* so that plugs 53 and 53*a* pass through bores 25 and 25*a* and engage bushings 23 and 23*a*. At the same time, contact part 39 is pulled against the tension force of first switch springs 15 and 15*a* and the force of lifting second switch springs 21 and 21*a* from stops 12 and 12*a*, producing the electric connection between flatiron 60, connection installation 3 and the power source.

While a particular embodiment has been chosen to illustrate the invention, it will be understood by those skilled in the art that various changes and modifications can be made therein without departing from the scope of the invention as defined in the appended claims.

What is claimed is:

1. A stand for a cordless electric appliance, comprising:

a base with a bottom member;

connection means, mounted on said base and extending generally perpendicular to said bottom member, for releasably coupling the cordless appliance to an electrical power source, said connection means having a housing shaped to receive a molded part of the cordless appliance to a wedge locking connection; and a support means, mounted on said base and spaced by a distance from said housing, for supporting the cordless appliance, said support means including a cylindrical member mounted on a plug projection extending upwardly and unitarily from said bottom member of said base.

2. A stand according to claim 1 wherein said cylindrical member comprises heat-resistant material.

3. A stand according to claim 1 wherein a cordless electric appliance is mounted on said stand and comprises a flatiron.

4. A stand according to claim 1 wherein said housing of said connection means tapers upwardly and comprises two bores on a top thereof for receiving plug contacts of the cordless appliance.

5. A stand according to claim 4 wherein a protection member is coupled to said housing for movement between a first position closing said bores and a second position opening said bores, said protection member having control means, contacted by the cordless appliance, for moving said protection member to said first position when engaged by the cordless appliance and for moving said protection member to said second position when detached from the cordless appliance.

6. A stand according to claim 1 wherein said support means extends upwardly from said bottom member; and an edge strip extends upwardly from said bottom member and for a distance greater than said support means.

7. A stand according to claim 6 wherein said bottom member is surrounded by a base part depending from a lower surface of said bottom member, said bottom member and said base part defining a U-shaped hollow space for mounting a connection cable, said edge strip and said bottom member having a recess permitting passage of the connection cable therethrough.

8. A stand according to claim 7 wherein said base part comprises a section extending substantially perpendicular to said bottom member, said section and said bottom member having a row of ventilation openings.

9. A stand for a cordless electric appliance, comprising:

a base with a bottom member;

connection means, mounted on said base and extending generally perpendicular to said bottom member, for releasably coupling the cordless appliance to an electrical power source, said connection means having a housing shaped to receive a molded part of the cordless appliance in a wedge locking connection;

a support means, mounted on said base and spaced by a distance from said housing, for supporting the cordless appliance, said support means extending upwardly from said bottom member;

an edge strip extending upwardly from said bottom member for a distance greater than said support means; and a base part surrounding said bottom member and depending from a lower surface of said bottom member, said bottom member and said base part defining a U-shaped hollow space for mounting a connection cable, said edge strip and said bottom member having a recess permitting passage of the connection cable therethrough, said base part having a section extending substantially perpendicular to said bottom member, said section and said bottom member having a row of ventilation openings.

10. A stand according to claim 9 wherein said support means comprises an appliance contacting member of heat-resistant material.

11. A stand according to claim 9 wherein a cordless electric appliance is mounted on said stand and comprises as flatiron.

12. A stand according to claim 9 wherein said housing of said connection means tapers upwardly and comprises two bores on a top thereof for receiving plug contacts of the cordless appliance.

13. A stand according to claim 12 wherein a protection member is coupled to said housing for movement between a first position closing said bores and a second position opening said bores, said protection member having control means, contacted by the cordless appliance, for moving said protection member to said first position when engaged by the cordless appliance and for moving said protection member to said second position when detached from the cordless appliance.

* * * * *